United States Patent [19]

Lansky et al.

[11] Patent Number: 4,761,902

[45] Date of Patent: Aug. 9, 1988

[54] UNIVERSAL PICTURE SUPPORT ASSEMBLY AND METHOD

[75] Inventors: Marc A. Lansky; Philip M. Clemens, both of Fort Wayne, Ind.

[73] Assignees: John F. Hoffman; Albert L. Jeffers, both of Fort Wayne, Ind. ; a part interest to each

[21] Appl. No.: 4,665

[22] Filed: Jan. 20, 1987

[51] Int. Cl.[4] ..... A47G 1/06

[52] U.S. Cl. ..... 40/155; 40/605

[58] Field of Search ..... 40/155, 158 R, 605, 40/152.1; 52/668; 446/106

[56] References Cited

U.S. PATENT DOCUMENTS

| | | | |
|---|---|---|---|
| 358,058 | 2/1887 | Nutter . | |
| 975,094 | 11/1910 | Williams . | |
| 1,296,544 | 3/1919 | Malkevic | 40/155 |
| 2,844,910 | 7/1958 | Korchak | 446/106 |
| 3,007,279 | 11/1961 | Korchak | 446/106 |
| 3,105,316 | 9/1962 | Ison | 40/155 |
| 3,571,999 | 7/1969 | Downing | 40/605 |
| 3,882,630 | 5/1975 | Bianco | 446/106 |
| 3,958,352 | 5/1976 | Eubank, Jr. | 40/155 |
| 4,209,922 | 7/1980 | Porreca | 40/155 |
| 4,384,416 | 5/1983 | Kanzelberger | 40/10 |
| 4,385,459 | 5/1983 | McGrath et al. | 40/155 |
| 4,458,873 | 7/1984 | Sutherland | 40/152.1 |
| 4,505,061 | 3/1985 | Neuburger et al. | 40/605 |

FOREIGN PATENT DOCUMENTS

| | | | |
|---|---|---|---|
| 2134944 | 8/1984 | United Kingdom | 40/158 R |

*Primary Examiner*—Gene Mancene

*Assistant Examiner*—Cary E. Stone

*Attorney, Agent, or Firm*—Jeffers, Hoffman & Niewyk

[57] ABSTRACT

A support assembly for facilitating the hanging or display of a picture, preferably provided in the form of an unassembled kit, includes a plurality of separate relatively rigid elongate channel-like grid members preferably identical in construction and a plurality of attachment members preferably in the form of double-sided, acid free adhesive strips for attaching the grid members to the back of a picture. Each grid member has a plurality of slots defined at uniformly spaced locations therealong for facilitating the breaking off of an end portion thereof to provide the grid member matched in length to a dimension, such as the length or width, of the picture. A plurality of spaced apart rupturable webs are provided which span each slot and integrally interconnect portions of the grid member that define opposite sides of each slot so as to reinforce the grid members at the locations of the slots. Also, each grid member has a plurality of notches defined at spaced locations therealong for facilitating interfitting of the grid members together in a gridwork pattern. The number of slots is greater than the number of transverse notches in each grid member. A hanger element can be provided for attachment to the gridwork for facilitating hanging the gridwork and thereby the picture attached thereto. The double-sided adhesive strips can be provided separate from the grid members or alternatively preapplied thereto so that they only need to be cut off to the lengths of the grid members and applied to the back of the picture.

33 Claims, 3 Drawing Sheets

UNIVERSAL PICTURE SUPPORT ASSEMBLY AND METHOD

BACKGROUND OF THE INVENTION

1. Field of the Invention

The present invention generally relates to displaying pictures and the like and, more particularly, is concerned with a universal grid support assembly and method which can be tailored to support and hang different sizes of mounted pictures. The term "picture" will be used generically hereafter to designate articles such as pictures, paintings, architectural drawings, photographs and other printed or artistic matter suitable for display and should not be considered as limiting the scope of the present invention.

2. Description of the Prior Art

A variety of mounting assemblies for the display of pictures are proposed in the prior art. Representative of the prior art are the mounting assemblies disclosed in U.S. Pat. Nos. to Williams (975,094), Ison (3,105,316), Eubank, Jr. (3,958,352), Porreca (4,209,922) and McGrath et al (4,385,459). Of the afore-cited patents, only the ones to Eubank, Jr., Porreca and McGrath et al address the problem of accommodating pictures of various sizes. However, these patents appear to embody one or more shortcomings which make them less than an optimum solution to the aforementioned problem. The picture frame of Eubank, jr. appears limited to use with a relatively rigid picture assembly composed of a front pane of glass, a picture and a backing member. The frame construction of Porreca involves a considerable number of parts which must be aligned and assembled together and are bulky in appearance which might be considered by some to detract from the aesthetic qualities of the picture being framed. The photo display tree of McGrath et al accommodates photographs of various sizes, while being sandwiched between clear plastic covers, by supporting the photographs, at most, only along two of their four edges in grooves in the members composing the display tree. Such arrangement would possibly allowing them over time to curl or bend.

Consequently, a need still exists for an alternative approach to displaying mounted pictures. The approach should be one which is relatively simple, unobtrusive with respect to the aesthetics of the picture and highly reliable in preserving the structural integrity of the picture, and assumes that the picture will only be backed or mounted, as is conventional practice, by a thin sheet of relatively stiff material, such as dry mount boards.

SUMMARY OF THE INVENTION

The present invention provides a universal picture support assembly and method designed to satisfy the aforementioned needs. The support assembly of the present invention employs a plurality of channel-shaped grid members having uniformly spaced notches for interfitting the members together in a criss-cross fashion and uniformly spaced slots for breaking or cutting off ends of the members to make the members of proper length to match a picture of a given size. Also, adhesive means, such as double-sized, acid-free adhesive strips, are utilized to attach the interfitted and properly sized grid members to the rear side of the picture so as to form a gridwork which reinforces the picture from edge-to-edge and facilitates hanging it on a wall by use of an ordinary picture hanger or nail.

The uniform spacing, for instance of one inch length, between the break-off slots makes it very easy for a user to determine the proper length for fitting the grid members to the particular standard size of picture to be mounted. However, since the grid members are preferably fabricated of injection molded plastic, they can also be reduced to the proper length for fitting non-standard size pictures by severing the member at a location between the break-off slots. It is preferred that the grid members be cut to length, as with a knife or scissors, and that the interconnecting webs be trimmed flush with the edges so that a clean, unobtrusive appearance is achieved. However, it is also possible to break off the ends of the grid members and then trim them flush with the edges.

The grid members preferably have identical constructions which allows the use of only one fabrication mold, reducing their cost of manufacture. The universal adaptability of the grid members to different picture sizes also makes the potential market for the assembly very large so that economies of scale can be achieved in the manufacture and marketing of the mounting assembly. Preferably, the grid members with double-sided adhesive strips either preapplied to the members or enclosed separately would be distributed in a kit form so that the user then purchases a kit tailored to a particular picture size range.

While the support assembly is applicable to pictures in the broad sense, it is particularly suited for mounting photographs. The grid members are attached directly to the rear side of a sheet of backing material which already has a photograph mounted to its front side. The grid members only extend to the edges of the backing sheet and photograph, and thus are not visible from the front. In such manner, there is no possibility that the support assembly will detract from the aesthetic qualities of the photograph being displayed. The use of acid-free adhesive for the double sided tape will not deteriorate the quality of photographs by leaching through the backing into the photograph. It is preferable that the grid members be of a color which is subdued and will render the grid members unobtrusive. For example, the grid members may be black or gray in color.

Accordingly the present invention is directed to a picture support assembly which comprises a plurality of relatively rigid elongate grid members, first means defined at a first plurality of spaced locations along each of the grid members for breaking off an end portion thereof to provide the grid member with a length matched with a dimension of a picture to be mounted be the assembly, second means defined at a second plurality of spaced locations along each of the grid members for facilitating interfitting of the grid members together in a gridwork pattern, and adhesive means on one side of each of the grid members for securing to the picture the grid members when interfitted in the gridwork pattern.

More particularly, the first means includes a plurality of transverse slots which are formed in a pair of longitudinal side walls and a longitudinal end wall interconnecting the side walls which together form the respective grid member. A plurality of spaced apart rupturable webs span each slot and integrally interconnect the side and end walls of the grid member at the opposite sides of each slot so as to reinforce the grid members at the locations of the slots. The second means includes a plurality of transverse notches which each are defined halfway through the side walls of the respective grid member with a pair of transverse walls and an intermediate wall being provided to reinforce the grid member at the location of each notch. The number of transverse slots is greater than the number of transverse notches in each grid member with the slots being spaced apart from one another at a distance which is less than the distance the notches are spaced apart from one another. Preferably, the slots are uniformly spaced apart about one inch, whereas the notches are spaced apart about five inches.

The present invention is also directed to a picture support assembly kit, comprising a plurality of separate relatively rigid elongate grid members, a plurality of slots defined at a first plurality of spaced locations along each of the grid members for facilitating the breaking off of an end portion thereof to provide the grid member matched in length to a dimension of a picture, a plurality of notches defined at a second plurality of spaced locations along each grid members for facilitating interfitting of the grid members together in a gridwork pattern, and means for attaching the grid members to the back of the picture. The attaching means is preferably a plurality of double-sided adhesive strips which can be provided separate from the grid members, or alternatively preapplied at one side to the grid members.

Also, the present invention is directed to a method of preparing a picture for hanging or other display which comprises the steps of providing a plurality of grid members having a plurality of slots defined in spaced apart relation along each grid member and a plurality of notches defined in spaced apart relation along each grid member, removing an end portion of each of the grid members at one of the slots therein to provide each grid member with a length matched with a dimension of the picture, forming the grid members together in a gridwork pattern by interfitting the grid members together at their respective notches, and attaching the grid members in the gridwork pattern to a back of the picture to be mounted. More particularly, the attaching step is performed by affixing to the back of the picture an adhesive side of a strip preapplied to each of the grid members. Alternatively, the attaching step is performed by affixing one side of each of a plurality of double-sided adhesive strips to the grid members and an opposite side of each of the adhesive strips to the back of the picture. However, before affixing the strips to the grid members and back of the picture, the strips must be cut to the same length as each of the grid members if not already affixed.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
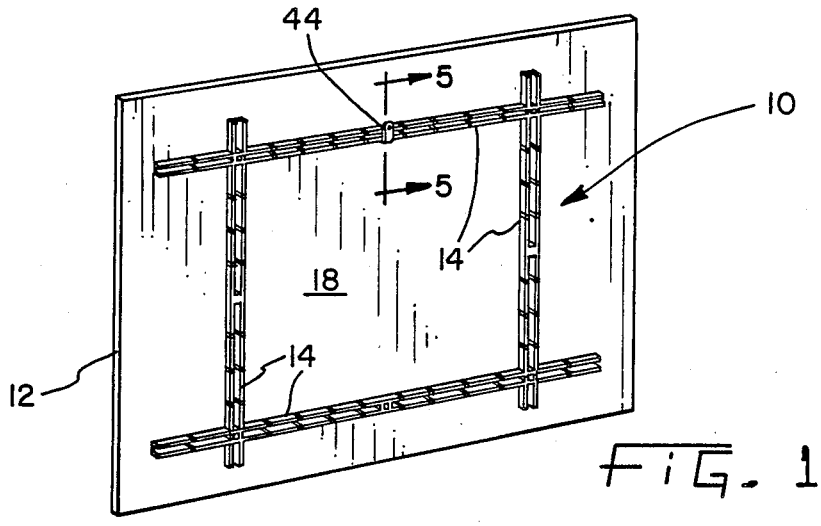
FIG. 1 is a perspective view of the rear side of a picture to which the universal support assembly of the present invention has been assembled for facilitating the hanging of the picture on a wall.

Referring now to the drawings, and particularly to FIGS. 1–7, there is shown a universal picture support assembly, generally designated by the numeral 10, which comprises the preferred embodiment of the present invention and can be used to support a picture 12, such as seen in FIG. 1. The picture support assembly 10 can most advantageously be provided in the form of an unassembled kit which is assembled by the user. The assembly 10 basically includes a plurality of separate relatively rigid elongate channel-like grid members 14 preferably identical in construction and a plurality of attachment members 16 preferably in the form of double-sided adhesive strips for attaching the grid members to the back 18 of the picture 12. Preferably, the grid members 14 are fabricated from a suitable plastic material, such as impact polystyrene, polypropylene or other rigid thermoplastic material by using a conventional injection molding process.

More particularly, each grid member 14, being channel-like in shape, has a pair of generally parallel laterally spaced apart longitudinal side walls 20 and a longitudinal end wall 22 extending between and interconnecting the side walls so as to provide the grid member 14 with a generally U-shaped cross sectional configuration. The side walls 20 and the end wall 22 together define a male side 24 and a female side 26 of the grid member 14.

Figure 7:
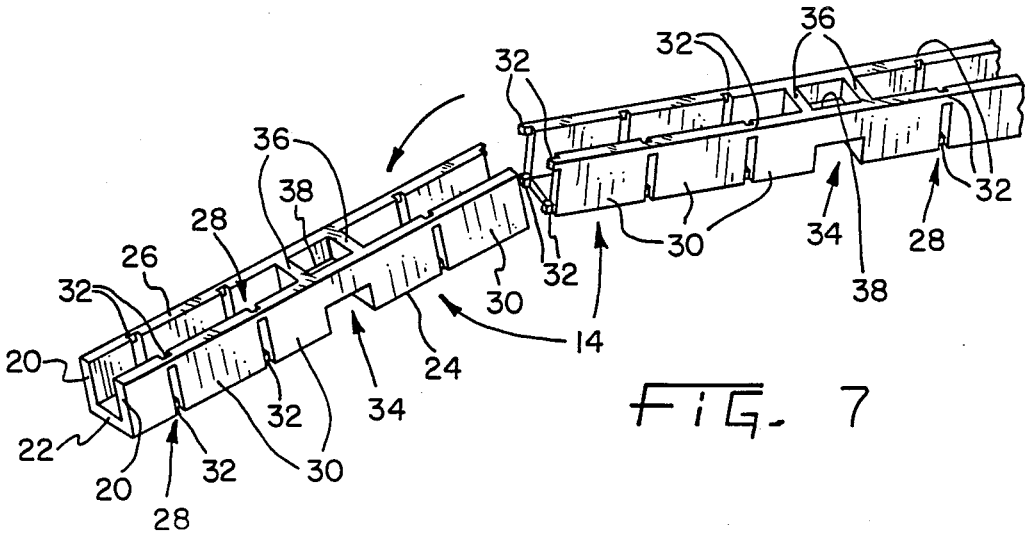
FIG. 7 is a perspective view of one of the grid members, illustrating how it is broken off to the desired length.
Figures 2, 2A, 3, 4:
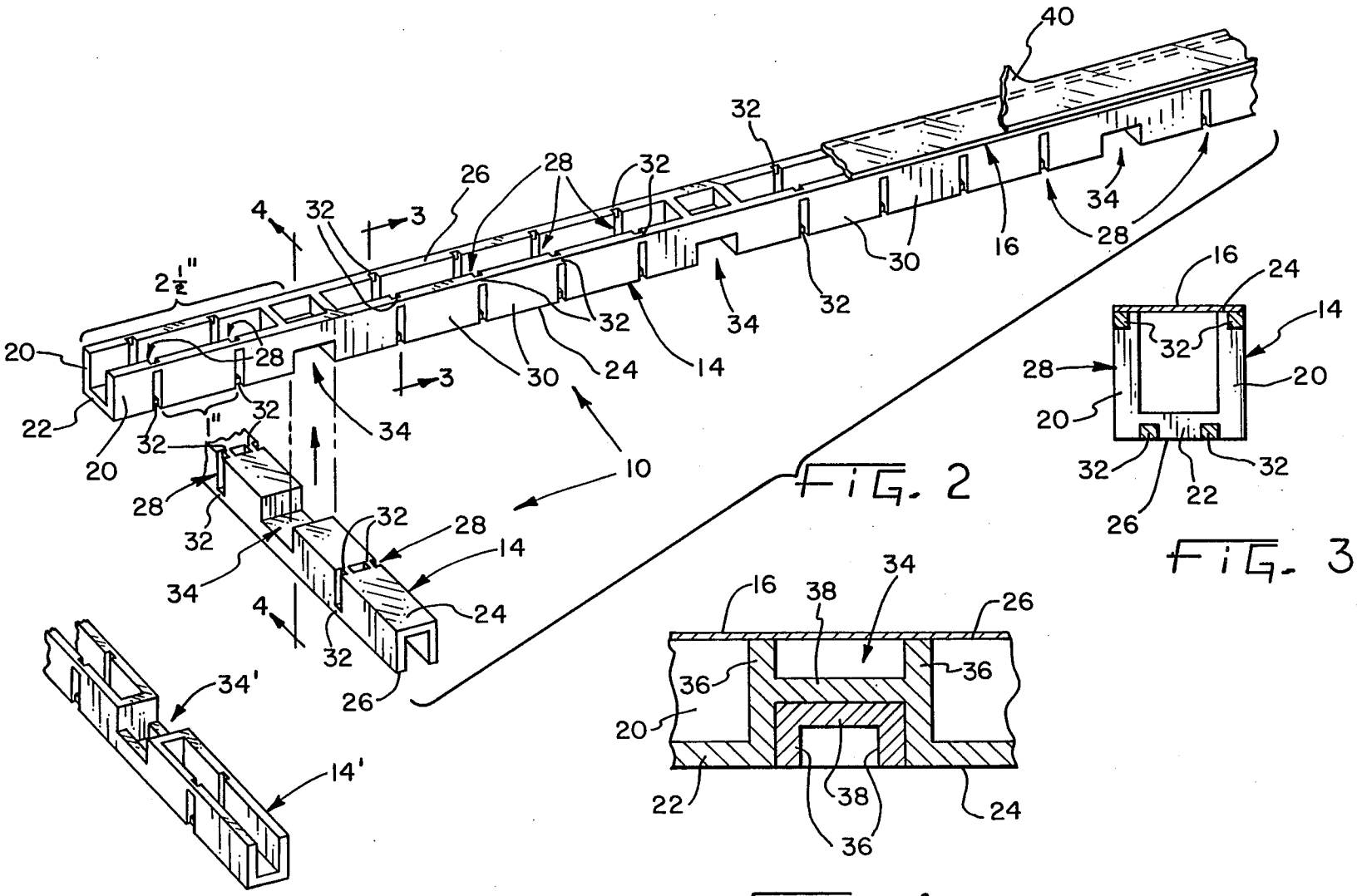
FIG. 2 is a perspective exploded fragmentary view of parts of a pair of identical grid members being aligned for interfitting to assemble into the grid pattern of the mounting assembly of the present invention.
FIG. 2A is a perspective view of a grid member being modified slightly from the construction of the grid members of FIG. 2.
FIG. 3 is an enlarged cross sectional view of the grid member taken along line 3—3 of FIG. 2.
FIG. 4 is an enlarged fragmentary cross sectional view of the interfitted grid members taken along line 4—4 of FIGS. 2 but after being assembled together.

Each grid member 14 has a plurality of spaced apart transverse slots 28 defined in its side and end walls 20, 22. The transverse slots 28 are provided at uniformly spaced locations along the length of the grid member 14 so as to divide it into segments 30 of generally equal length and form a plurality of spaced apart rupturable webs 32 which span each slot 20 and integrally interconnect the side and ends walls 20, 22 of the grid member 14, as seen in FIG. 3, that define opposite sides of each slot. The webs 32, by being arranged in spaced apart relationship about the cross section of each slot 28 near the periphery of the grid member cross section, serve to reinforce the respective grid member 14 at the locations of its slots 20 between its segments 30. However, the webs 32 are sufficiently thin in cross section to be rupturable upon a selected length of the interconnected segments 30 of the grid member 14 being bent relative to the remainder of the member, such as seen in FIG. 7. Thus, the webs 32 facilitate the breaking off or cutting off of the selected length of segments 30 to provide, in turn, the grid member 14 with a length matched to a dimension, such as the length or width, of the picture 12.

Each grid member 14 also has a plurality of spaced apart transverse notches 34 defined in its side and end walls 20, 22. The transverse notches 34 are provided at spaced locations along the length of the grid member 14 so as to facilitate interfitting of the grid members together into a gridwork pattern, as depicted in FIG. 1. Whereas each of the slots 28, except for the interconnecting webs 32, are defined transversely through the cross section of the side and end walls 20, 22 of the grid member 14, each of the notches 22 are only defined transversely through approximately one-half of the cross section of the side walls 20 of the grid member. Furthermore, whereas the slots 28 tend to weaken the grid member, 14, the notches 34 do not. As seen in FIGS. 2 and 4, the grid member 14 is reinforced at the locations of the notches by a pair of spaced transverse walls 36 which extend between and interconnect the side and end walls 20, 22 of the grid member and by an intermediate wall 38 which interconnects the transverse walls. In the embodiment of FIG. 2 wherein each of the grid members 14 are identical, the notches 34 open at the male side 24 of the grid member 14. In a modified embodiment of one of the grid members 14' seen in FIG. 2A, the notches 34' open at the female side 26 of the grid member.

Figure 1A:
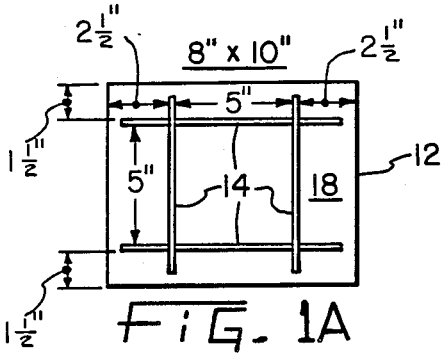
FIG. 1A is a rear view of the picture of FIG. 1, showing diagrammatically one of the grid patterns which can be provided by the assembled universal mounting assembly.
Figure 9:
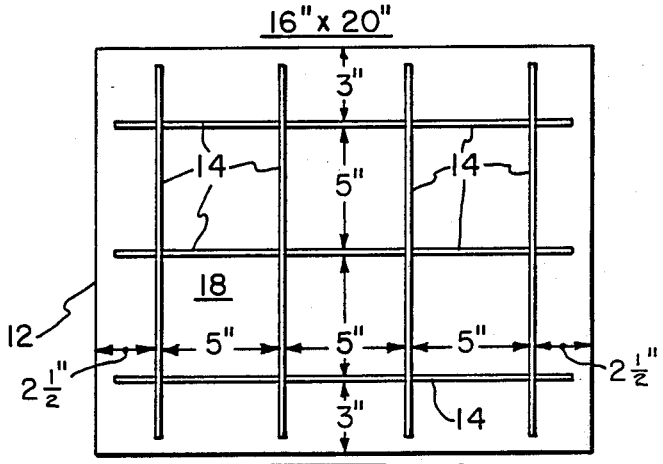
FIG. 8–10 are respective rear views of the picture similar to that of FIG. 1A, showing diagrammatically others of the grid patterns which can be provided by the assembled universal support assembly.
Figure 8:
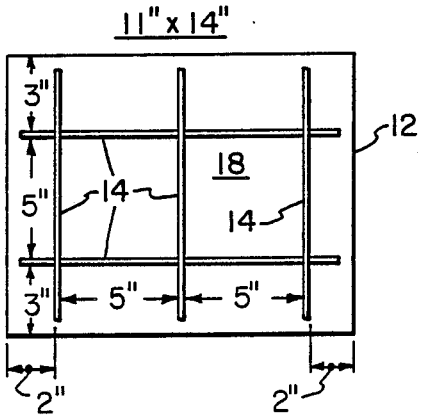
Figure 10:
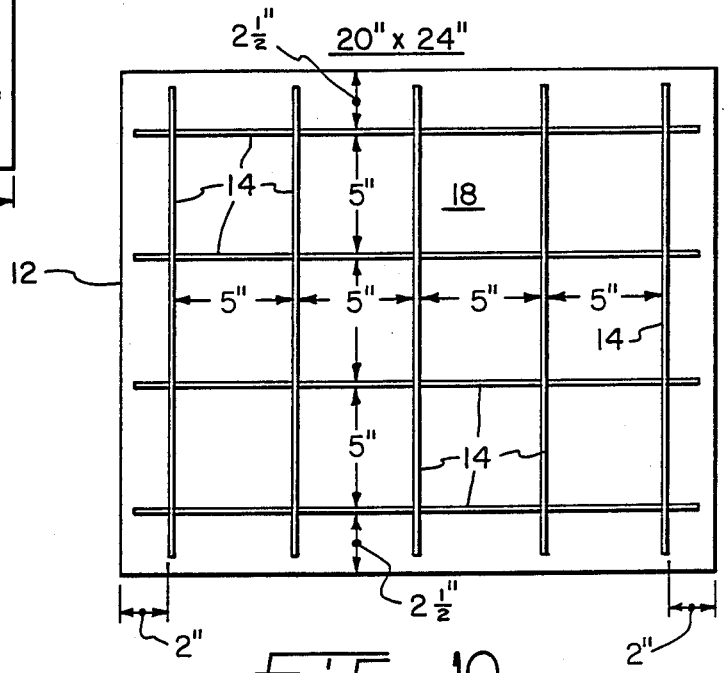

Also referring to FIGS. 2 and 7, it will be observed that the number of transverse slots 28 is much greater than the number of transverse notches 34 in each grid member 14. The slots 28 are spaced apart from one another at a generally uniform distance which is much less than the distance at which the transverse notches 34 are spaced apart from one another. In the preferred embodiment, the distance between the transverse slots 28 is about one inch, whereas the distance between the transverse notches 34 is about five inches. Selection of this set of distances allows tailoring of the grid members 14 to form respective gridwork patterns which will accurately fit widely-accepted standard pictures sizes, namely 8"×10" shown in FIG. 1A, 11"×14" shown in FIG. 8, 16"×20" shown in FIG. 9, and 20"×24" shown in FIG. 11.

Figure 6:
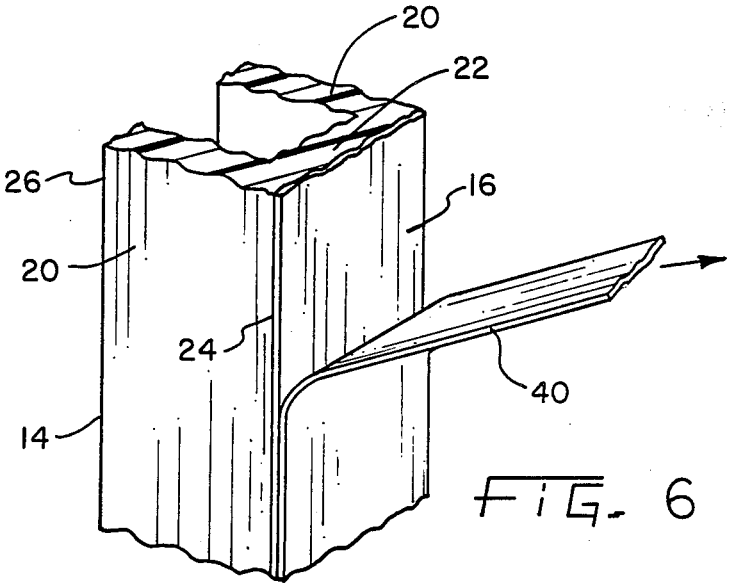
FIG. 6 is an enlarged fragmentary view of one grid member having a double-sided adhesive strip attached thereon.

The attachment members 16 preferably in the form of doublesided, acid free strips which are used for securing the grid members 14 to the picture 12 when the members are interfitted in said gridwork pattern can be preassembled to the grid members 14 or provided in the unassembled kit as separate pieces. In either case, a backing strip 40 normally covers the unattached adhesive surface 42 and must be peeled off as seen in FIG. 6. In FIG. 2, the strip 16 is shown preapplied on the female side 26 of the grid member 14, whereas in FIG. 6 it is preapplied to the male side 24. Where the grid members 14 are identical, as in FIG. 2, the grid members 14 which form the horizontal members of the gridwork pattern will have the strips 16 applied to the opposite one of the male or female sides thereof from that side of the grid members which form the vertical members of the gridwork pattern. However, where the grid members 14, 14' are not exactly identical, as in FIG. 2A, the strips 16 will be applied to the same one of the male or female sides on both of the nonidentical grid members. Regardless of whether the adhesive strips 16 are provided separate from the grid members 14 or alternatively preapplied thereto, they need to be cut off to the lengths of the grid members and adhesively applied to the back 18 of the picture 12.

Figure 5:
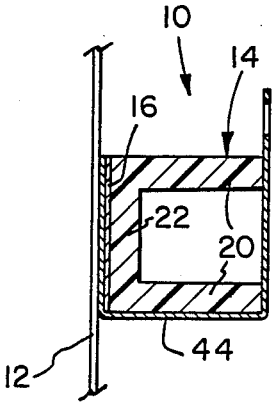
FIG. 5 is an enlarged fragmentary sectional view of one of the assembled grid members taken along line 5—5 of FIG. 1, showing an optional hanger element anchored to the grid member.
Figure 11:
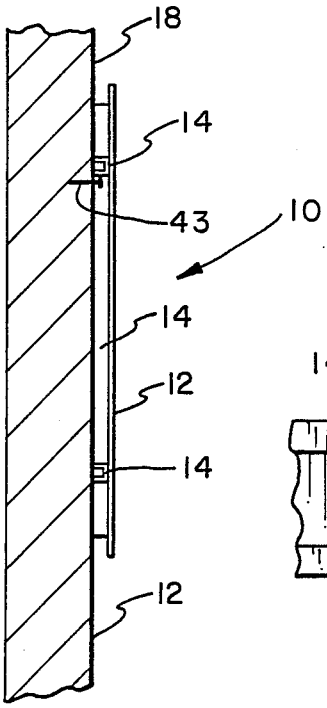
FIG. 11 is a fragmentary side elevational view cf the mounting assembly of the present invention assembled on the rear side of a picture with the picture, in turn, being hung on a wall.

Finally, some means for connecting grid members 14 when assembled into the gridwork pattern can be provided for facilitating hanging of the grid members 14 and the picture 12 secured thereto on a wall. For example, a conventional hanger or hook element 44, such as shown in FIGS. 1, 5 and 11 can be provided to anchor to one of the grid members 14 of the gridwork for facilitating hanging the gridwork and thereby the picture attached thereto. Alternatively, the assembled grid and picture can be hung by means of a common picture nail 43 on which one of the horizontal grid members 14 is supported (FIG. 11).

In preparing a picture 12 for hanging using a plurality of the grid members 14 having the plurality of slots 28 defined in spaced apart relation along each grid member and the plurality of notches 34 defined in spaced apart relation along each grid member, the grid members are first made to fit the size of the picture. First, end segments 30 of appropriate lengths are broken off the respective grid members 14 at the correct slots 28 therein to provide the grid members with lengths matched to length and width dimensions of the picture 12 to be mounted. Next, the grid members 14 are formed together into a gridwork pattern by interfitting the grid members 14 together at their respective notches 34. Then the grid members 14 in the respective gridwork pattern are attached to the back 18 of the picture 12. The grid members 14 are affixed to the back of the picture either by the use of an adhesive side of the strip 16 preapplied to each of the grid members, or by using a separate strip and affixing one side of each strip to the respective grid member and then an opposite side of adhesive strip to the picture, after removal of the respective backing strips. In either case, first each of the adhesive strips has to be cut to the same length as that of each of the grid members 14.

Figure 12:
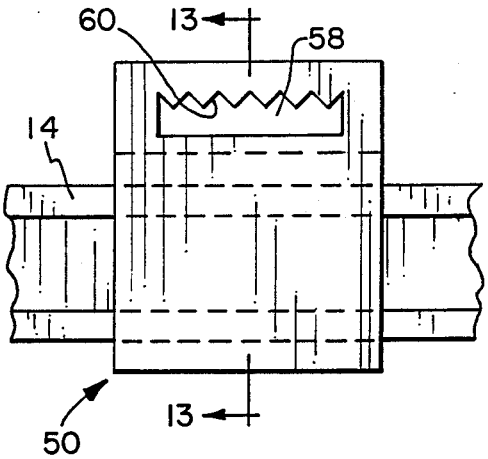
FIG. 12 is an enlarged fragmentary view of a modified hanger clip.
Figure 13:
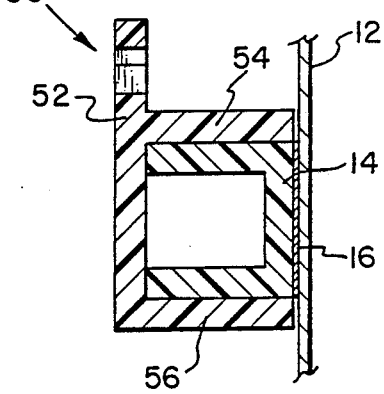
FIG. 13 is a sectional view taken along line 13—13 of FIG. 12 and viewed in the direction of the arrows.

An alternative optional hanging bracket 50 is illustrated in FIGS. 12 and 13. Hanging bracket 50 may be formed of the same thermoplastic material as grid members 14 and comprises a base portion 52 from which extend two spaced-apart grid engaging portions 54 and 56, which are spaced apart sufficiently to provide a frictional press fit with a horizontal grid member 14. An opening 58 in base portion 52 is provided with serrations 60 so that the bracket can be adjustably hung from a nail or hook (not shown) attached to the wall. Bracket 52 can be adjustably slid along grid member 14 to center it in the grid assembly thereby balancing the hung picture. Serrations 60 provide additional adjustment for balancing of the hung picture. Serrations 60 provide additional adjustment for balance of the hung picture 12. It will be noted that bracket 50 is designed such that it can be injection molded, preferably in the same tooling as grid members 14 are molded.

It is thought that the universal picture support assembly and method of the present invention and many of its attendant advantages will be understood from the foregoing description and it will be apparent that various changes may be made in the form, construction and arrangement of the parts and steps thereof without departing from the spirit and scope of the invention or sacrificing all of its material advantages, the form hereinbefore described being merely a preferred or exemplary embodiment thereof.

What is claimed is:

1. A universal picture support assembly, comprising:

a plurality of relatively rigid elongate grid members;

first means defined at a first plurality of spaced locations along each of said grid members for facilitating the breaking off of an end portion thereof to provide said grid member matched in length to a dimension of a picture to be mounted by said assembly;

second means defined at a second plurality of spaced locations along each of said grid members for facilitating interfitting of said grid members together in a gridwork pattern; and attaching means on one of a pair of opposite sides of said grid members for securing to the back of the picture said grid members when interfitted in said gridwork pattern.

2. The assembly as recited in claim 1, further comprising:

means connectable to at least one of said grid members when in said gridwork pattern for facilitating hanging of said grid members and the picture secured thereto on a wall.

3. The assembly as recited in claim 1, wherein said first means includes a plurality of transverse slots defined in each grid member at said first plurality of locations therealong.

4. The assembly as recited in claim 3, wherein each grid member is formed by a pair of longitudinal side walls and a longitudinal end wall interconnecting said side walls, said transverse slots being formed through said side and end walls.

5. The assembly as recited in claims 4, wherein said first means further includes a plurality of spaced apart rupturable webs which span each slot and integrally interconnect portions of said side and end walls of said grid member at opposite sides of each slot so as to reinforce the grid members at the locations of the slots.

6. The assembly as recited in claim 1, wherein said second means includes a plurality of transverse notches defined in each grid member at said second plurality of locations therealong.

7. The assembly as recited in claim 6, wherein each grid member is formed by a pair of longitudinal side walls and a longitudinal end wall interconnecting said side walls, said transverse notches being formed through portions of said side walls.

8. The assembly as recited in claim 6, wherein said first means includes a plurality of transverse slots defined in each grid member at said first plurality of locations therealong.

9. The assembly as recited in claim 8, wherein the number of said transverse slots is greater than the number of said transverse notches in each said grid member.

10. The assembly as recited in claim 8, wherein said first means further includes a plurality of spaced apart rupturable webs which span each slot and integrally interconnect portions of said grid member which define opposite sides of each slot so as to reinforce the grid members at the locations of the slots.

11. The assembly as recited in claim 8, wherein said transverse slots are spaced apart from one another at a distance which is less than the distance said transverse notches are spaced apart from one another.

12. The assembly as recited in claim 11, wherein the distance said transverse slots are spaced apart is about one inch.

13. The assembly as recited in claim 11, wherein the distance said transverse notches are spaced apart is about five inches.

14. The assembly as recited in claim 8, wherein said grid members are substantially identical in their arrangements of said slots and notches.

15. The picture support assembly of claim 1 and including a bracket having a pair of spaced apart leg portions in which one of said grid members is frictionally retained, said bracket including means thereon for hanging the bracket from a vertical wall.

16. The picture support assembly of claim 15 wherein said means for hanging comprises an opening in said bracket having serrations therein for laterally adjusting the position of the bracket on a nail or the like fastened to a wall.

17. A picture support assembly kit comprising:

a plurality of separate relatively rigid elongate grid members;

a plurality of slots defined at a first plurality of spaced locations along each of said grid members for facilitating the breaking off of an end portion thereof to provide a grid member matched in length to a selected dimension of a picture;

a plurality of notches defined at a second plurality of spaced locations along each of said grid members for facilitating interfitting of said grid members together in a gridwork pattern; and means for attaching said grid members to the back of the picture.

18. The kit as recited in claim 17, further comprising:

means connectable to at least one of said grid members for facilitating the hanging of said grid members when assembled in said gridwork pattern and attached to the picture.

19. The kit as recited in claim 17, wherein said attaching means is a plurality of double-sided adhesive strips separate from said grid members.

20. The kit as recited in claim 17, wherein said attaching means is a plurality of double-sided adhesive strips preapplied at one side to said grid members.

21. The kit as recited in claim 17, wherein each grid member includes a plurality of spaced apart rupturable webs which span each slot and integrally interconnect portions of said grid member which define opposite sides of each slot so as to reinforce the grid members at the locations of the slots.

22. The kit as recited in claim 17, wherein the number of said transverse slots is greater than the number of said transverse notches in each said grid member.

23. The kit as recited in claim 17, wherein said transverse slots are spaced apart from one another at a distance which is less than the distance said transverse notches are spaced apart from one another.

24. The kit as recited in claim 23, wherein the distance said transverse slots are spaced apart is about one inch.

25. The kit as recited in claim 23, wherein the distance said transverse notches are spaced apart is about five inches.

26. The kit as recited in claim 17, wherein said grid members are substantially identical in their arrangement of said slots and notches.

27. A method of preparing a picture for hanging, comprising the steps of:

providing a plurality of grid members having a plurality of transverse slots defined in spaced apart relation along each grid member and a plurality of transverse notches defined in spaced apart relation along each grid member;

removing an end portion of each of said grid members at one of said slots therein to provide said each grid member with a length matched to a dimension of a picture to be mounted;

forming said grid members together in a gridwork pattern by interfitting said grid members together at their respective notches; and attaching said grid members in said gridwork pattern to a back of the picture to be mounted.

28. The method as recited in claim 27, wherein said attaching step is performed by affixing to the back of the picture an adhesive side of a strip preapplied to each of said grid members.

29. The method as recited in claim 24, wherein said attaching step is performed by affixing one side of each of a plurality of double-sided adhesive strips to said grid members and an opposite side of each of said adhesive strips to the back of the picture.

30. The method as recited in claim 29, wherein said attaching step is performed by first cutting each of said plurality of double-sided adhesive strips to the same length as each of said grid members and then carrying out said affixing of said respective one and opposite sides of said strip to said each grid member and the back of the picture.

31. A picture support assembly comprising:

a frame comprising a plurality of rigid, elongate grid members removeably interlocked in an orthogonal gridwork pattern, the grid members being interlocked by means of notches located at spaced intervals on at least some of said grid members into which other grid members are received, means defined at a plurality of spaced locations along each of said grid members for facilitating the breaking off of an end portion thereof to provide said grid member matched in length to a dimension of a picture to be mounted by said assembly, and adhesive means on one side of said frame for attaching a picture to said frame.

32. The assembly of claim 31 wherein said adhesive means is a plurality of double-sided adhesive strips connected to the grid members of said frame.

33. The assembly of claim 31 wherein said adhesive means comprises an adhesive layer on one side of the grid members having a removable protective strip thereon, wherein the protective strip is removed prior to attaching a picture to said frame.

* * * * *